US011127542B2

(12) United States Patent
Kralik et al.

(10) Patent No.: US 11,127,542 B2
(45) Date of Patent: Sep. 21, 2021

(54) ELECTRICAL SWITCHING APPARATUS COMPRISING AN IMPROVED ARC-QUENCHING DEVICE

(71) Applicant: Schaltbau Gmbh, Munich (DE)

(72) Inventors: Robert Kralik, Poing (DE); Daniel Hammerl, Langenzerdorf (AT)

(73) Assignee: Schaltbau GmbH, Munich (DE)

( * ) Notice: Subject to any disclaimer, the term of this patent is extended or adjusted under 35 U.S.C. 154(b) by 0 days.

(21) Appl. No.: 16/759,216

(22) PCT Filed: Jul. 31, 2018

(86) PCT No.: PCT/EP2018/070713

§ 371 (c)(1),
(2) Date: Apr. 24, 2020

(87) PCT Pub. No.: WO2019/081083

PCT Pub. Date: May 2, 2019

(65) Prior Publication Data

US 2020/0312583 A1 Oct. 1, 2020

(30) Foreign Application Priority Data

Oct. 27, 2017 (DE) ..... 10 2017 125 260.6

(51) Int. Cl.
*H01H 9/44* (2006.01)

(52) U.S. Cl.
CPC ..... *H01H 9/443* (2013.01)

(58) Field of Classification Search
CPC ..... H01H 9/443; H01H 9/34; H01H 9/36; H01H 33/182; H01H 33/187; H01H 33/18; H01H 50/38; H01H 73/18; H01H 73/38

(Continued)

(56) References Cited

U.S. PATENT DOCUMENTS 2,332,446 A * 10/1943 Heinrich ..... H01H 9/443 218/26
2,575,060 A * 11/1951 Matthias ..... H01H 9/443 218/25

(Continued)

FOREIGN PATENT DOCUMENTS

DE 1 540 144 B1 4/1970
WO 2015/144309 A1 10/2015

OTHER PUBLICATIONS

International Search Report (ISR) dated Oct. 11, 2018 from corresponding International Patent Application PCT/EP2018/070713 (four pages).

*Primary Examiner* — William A Bolton
(74) *Attorney, Agent, or Firm* — Kilpatrick Townsend & Stockton LLP

(57) ABSTRACT

The present invention relates to an electrical switching apparatus having at least one contact point, an arc-quenching device associated with the contact point, and an arc-blowing device to generate a magnetic blowout field. The arc-quenching device comprises a plurality of quenching elements, which are arranged distributed and spaced from each other in a first direction, wherein the quenching elements each comprise a permanent magnet. The arc arising when the contact point is opened is blown away from the contact point towards the quenching elements by the magnetic blowout field. The magnetic blowout field is at least partially generated or supported by the permanent magnets of the quenching elements. According to the invention, the permanent magnets of the quenching elements are offset with respect to each other in a second direction that is perpendicular to the first direction.

16 Claims, 5 Drawing Sheets

Figure 1:
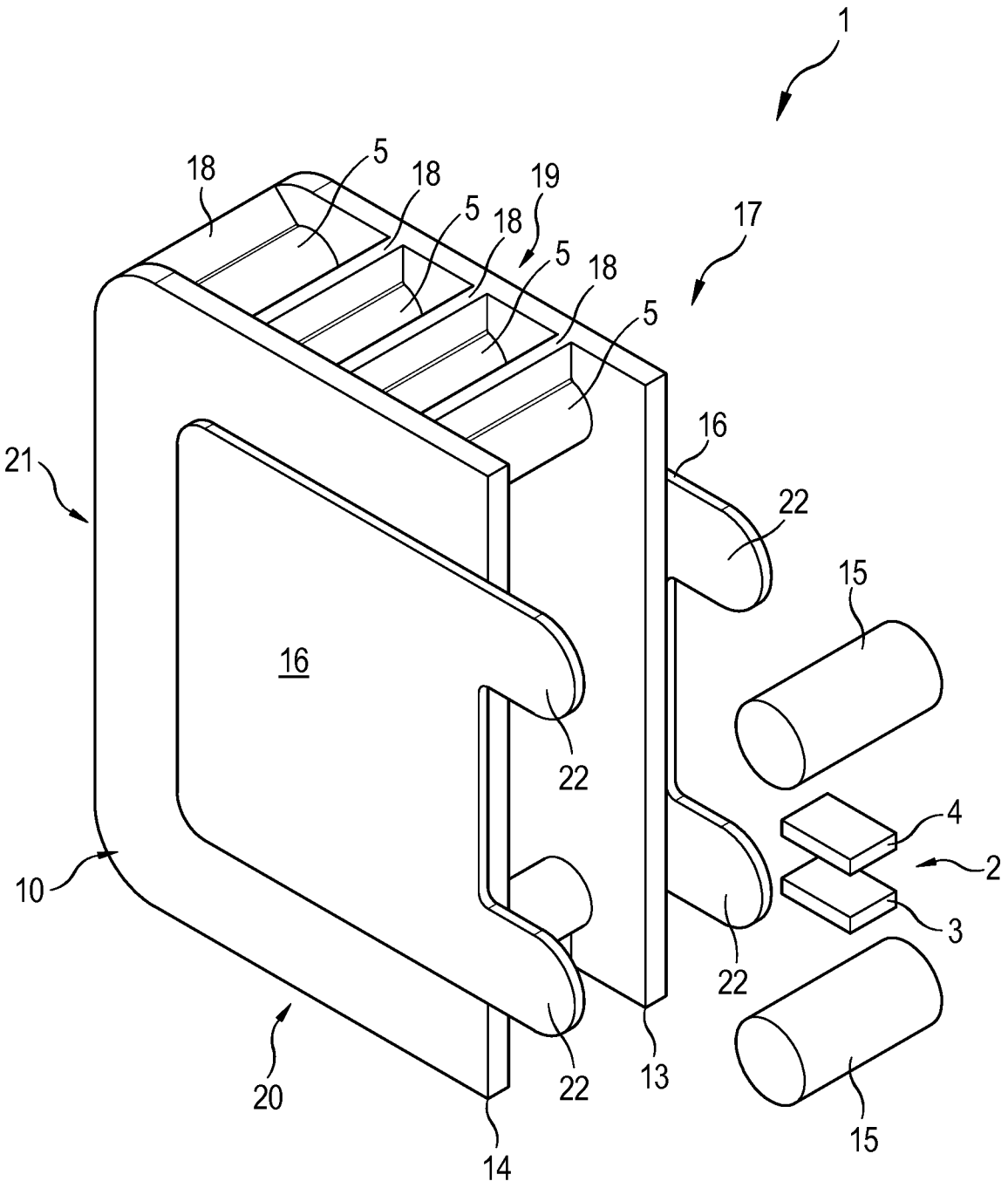

(58) Field of Classification Search
USPC ..... 218/22, 23, 26, 34, 30, 38
See application file for complete search history.

(56) References Cited

U.S. PATENT DOCUMENTS

| | | | | | |
|---|---|---|---|---|---|
| 3,369,095 | A * | 2/1968 | Maggi | H01H 9/443 | 218/25 |
| 3,953,694 | A | 4/1976 | Bernard et al. | | |
| 4,367,448 | A * | 1/1983 | Nishizako | H01H 9/443 | 218/26 |
| 6,064,024 | A * | 5/2000 | Moldovan | H01H 9/443 | 218/22 |
| 8,653,917 | B2 * | 2/2014 | Takaya | H01H 9/443 | 335/201 |
| 9,406,465 | B1 * | 8/2016 | Fasano | H01H 9/443 | |
| 2016/0217951 | A1 * | 7/2016 | Kralik | H01H 9/443 | |
| 2017/0178831 | A1 * | 6/2017 | Kralik | H01H 33/596 | |

* cited by examiner

ELECTRICAL SWITCHING APPARATUS COMPRISING AN IMPROVED ARC-QUENCHING DEVICE

This application is a US National Phase of PCT/EP2018/070713, filed Jul. 31, 2018, which claims priority to German Patent Application No. 10 2017 125 260.6 filed Oct. 27, 2017, the entireties of which are incorporated by reference herein.

The present invention relates to an electrical switching apparatus according to the preamble of the independent claim 1.

A generic electrical switching apparatus comprises at least one contact point, an arc quenching device associated with the contact point, and an arc blowing device for generating a magnetic blowout field. The arc quenching device comprises a plurality of quenching elements which are arranged spaced apart from one another and distributed along a first direction, the quenching elements each comprising a permanent magnet. Due to the magnetic blowout field, a switching arc arising when the contact point is opened is blown away from the contact point towards the quenching elements. The magnetic blowout field is at least partially generated or supported by the permanent magnets of the quenching elements.

An electrical switching apparatus according to the preamble of the independent claim 1 is known from WO 2015/144309 A1, for example. The electrical switching apparatus known from this publication comprises a quenching chamber, in front of whose outlet opening several cylindrical permanent magnets are arranged, which on the one hand support the permanently magnetically generated magnetic blowout field and on the other hand simultaneously form quenching elements and are arranged and polarized in such a way that the switching arc is attracted by the permanent magnets and is thereby quenched. The permanent magnets are preferably each enclosed by a protective sleeve made of ceramic at least in the area which is exposed to the arc.

It is the object of the present invention to indicate an electrical switching apparatus of the generic type comprising an improved arc-quenching device, whereby the electrical switching apparatus is to be kept particularly compact.

The object is achieved by the features of the independent claim 1. Thus, an electrical switching apparatus according to the preamble of the independent claim 1 achieves the object in an inventive manner if the permanent magnets of the quenching elements are offset with respect to each other in a second direction perpendicular to the first direction. Also in the present invention, the permanent magnets of the quenching elements are arranged and polarized in such a way that the switching arc is attracted by the permanent magnets or sucked onto the permanent magnets and quenched by the permanent magnets. On the way from the contact point to the permanent magnets of the quenching elements the switching arc is elongated. The offset provided according to the invention between the permanent magnets of the quenching elements causes an additional elongation of the switching arc by the switching arc being distorted, for example, in a wave or zigzag shape. This distortion of the switching arc leads to a reliable quenching of the switching arc with a particularly compact design of the switching apparatus according to the invention.

Advantageous embodiments of the present invention are the subject matter of the sub-claims.

According to a particularly preferred embodiment of the present invention, the second direction runs parallel to a main direction of the magnetic blowout field. Since the direction of movement of the switching arc and the main direction of the magnetic blowout field are perpendicular to each other, the second direction is thus perpendicular to the direction of movement of the switching arc. This embodiment enables a particularly pronounced distortion or additional elongation of the switching arc due to the offset of the permanent magnets of the quenching elements. The main direction of the magnetic blowout field corresponds to the magnetization direction of the permanent magnets of the quenching elements and, if provided, to the magnetization direction of a dedicated blowing magnet.

According to another particularly preferred embodiment of the present invention, the permanent magnets of the quenching elements, viewed in a plane spanned by the first direction and the second direction, are arranged according to a wave-shaped pattern. This embodiment also ensures that the switching arc is particularly strongly elongated and can thereby be quenched particularly reliably. The wave-shaped pattern preferably comprises a plurality of wave valleys and wave crests. The wave-shaped pattern is also preferably a sine wave. The permanent magnets of the quenching elements are preferably arranged at least both at the zero crossing of the waveform and in the positive and negative vertices of the waveform.

According to an alternative embodiment of the present invention, the permanent magnets of the quenching elements, viewed in a plane spanned by the first direction and the second direction, are arranged according to a zigzag pattern. This embodiment also allows a particularly strong distortion or additional elongation of the switching arc.

According to another particularly preferred embodiment of the present invention, the quenching elements each comprise a protective sleeve made of an electrically insulating material which surrounds the respectively associated permanent magnet of the quenching element. The electrically insulating material is advantageously heat-resistant. This embodiment enables a particularly long service life of the electrical switching apparatus according to the invention.

The protective sleeve is particularly preferably made of ceramic. However, protective sleeves made of heat-resistant plastic or other suitable materials are also conceivable, for example.

According to another particularly preferred embodiment of the present invention, the quenching elements comprise spacers by which the permanent magnets are held in different positions within the protective sleeves, resulting in the offset existing in the second direction between the permanent magnets of the quenching elements. This embodiment ensures a particularly simple construction and easy installation of the electrical switching apparatus according to the invention.

The spacers are particularly preferably part of a holder which holds all quenching elements of the arc quenching device in position. This also results in a simplified construction of the switching apparatus according to the invention. The holder is preferably designed in two parts, wherein a first spacer of each quenching element is respectively designed in one piece with the first half of the holder, and a second spacer of the same quenching element is designed in one piece with the second half of the holder. The associated permanent magnet of the quenching element is arranged between the two spacers. Depending on how large the offset is selected, one of the two spacers can also be omitted. The holder is preferably made of ceramic. Alternatively, it can also be made of a temperature-resistant plastic.

According to another particularly preferred embodiment of the present invention, the arc blowing device comprises at least one dedicated blowing magnet which has assigned thereto two pole plates aligned parallel to each other, the pole plates together with the quenching elements forming an assembly which can be removed from the switching apparatus without tools and which can be magnetically locked with the blowing magnet. A homogeneous magnetic blowout field is generated by the blowing magnet, which is preferably also designed as a permanent magnet, and the two pole plates associated with the blowing magnet. This embodiment has above all the advantage that the assembly consisting of the quenching elements and the pole plates can be removed particularly easily and quickly from the electrical switching apparatus according to the invention for maintenance purposes. The at least one blowing magnet must not be part of this assembly. The at least one blowing magnet is rather firmly connected to a chassis of the electrical switching apparatus. Preferably, two blowing magnets are provided per arc blowing device. Further preferably, the pole plates have lugs which can be magnetically locked with the corresponding blowing magnet. Preferably, the blowing magnets are each located between a lug of the first pole plate and a lug of the second pole plate when the assembly consisting of the quenching elements and the pole plates is locked with the blowing magnets.

According to another particularly preferred embodiment of the present invention, the quenching elements have each assigned thereto a rib running substantially perpendicular to the first direction and perpendicular to the second direction on an outer side facing away from the contact point. The ribs prevent an undesired re-ignition of the switching arc outside the quenching area. The ribs are preferably part of the holder and can be made of plastic or better of ceramic. Along the direction of movement of the switching arc, the ribs represent, so to speak, an extension of the quenching elements. They protrude preferably centrally from the respective sleeve to the outside. The ribs are similar to conventional quenching elements.

According to another preferred embodiment of the present invention, the quenching elements are arranged on two opposite sides as well as on a side of a quenching chamber of the electrical switching apparatus connecting the two opposite sides. This embodiment of the present invention enables both a particularly compact construction and a particularly reliable quenching of the switching arc.

The permanent magnets of the quenching elements are preferably particularly strong permanent magnets. The permanent magnets can, for example, consist of neodymium-iron-boron. Alternatively, the permanent magnets can also consist of hard ferrite. Further preferably, the permanent magnets are designed as cylindrical bar magnets so that low-cost standard magnets can be used. In this case, the protective sleeves are hollow cylindrical.

The present invention is particularly suitable for a precharge contactor.

An embodiment of the present invention shall be explained hereinafter in more detail with reference to drawings.

Figure 2:
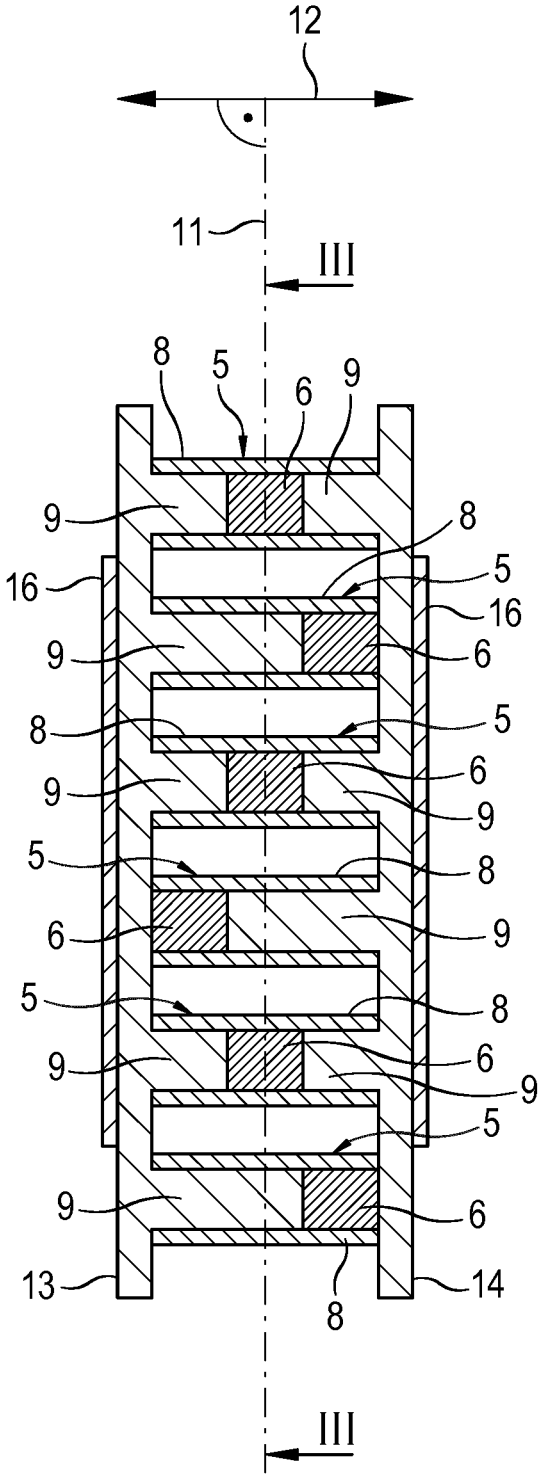
Figure 3:
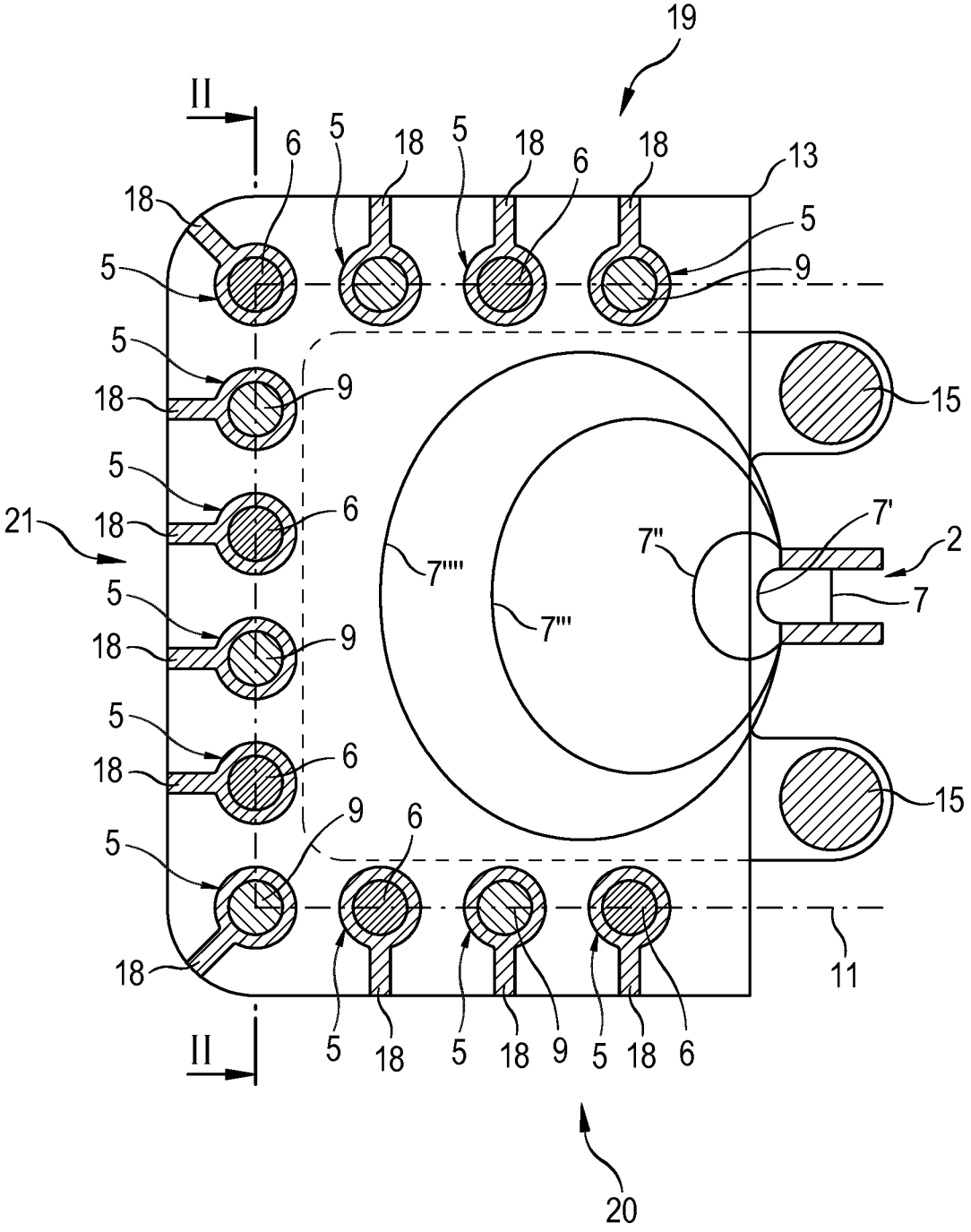
Figure 4:
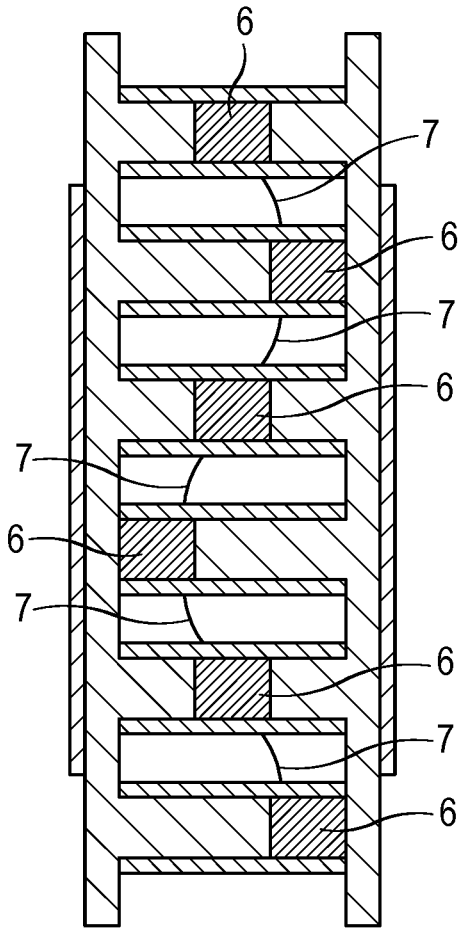
Figure 5:
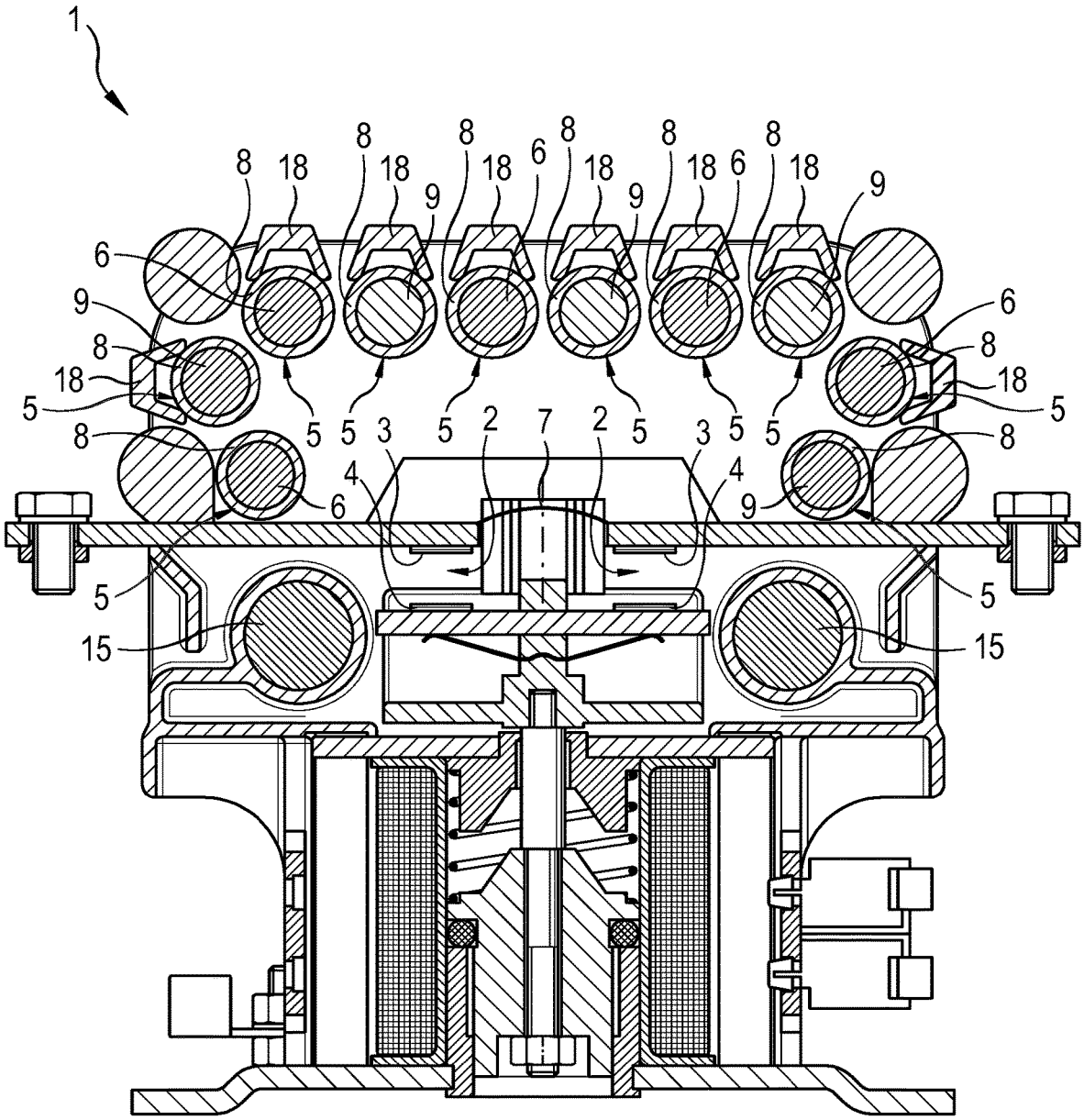

FIG. 1 shows a schematic representation of an electrical switching apparatus according to the invention according to a first embodiment in an oblique view, FIG. 2 shows a cross section through the electrical switching apparatus according to the invention from FIG. 1 along the sectional line II drawn in FIG. 3, FIG. 3 shows a longitudinal section through the electrical switching apparatus according to the invention from FIGS. 1 and 2 along the sectional line III drawn in FIG. 2, FIG. 4 shows the cross section from FIG. 2 in an application with an appropriately elongated switching arc, and FIG. 5 shows a longitudinal section through a switching apparatus according to the invention according to a second embodiment.

For the following explanations, identical parts are identified by identical reference signs. If a figure contains reference signs which are not discussed in more detail in the associated figure description, reference is made to previous or subsequent figure descriptions.

FIG. 1 shows a diagrammatic representation of an electrical switching apparatus 1 according to the invention in an oblique view. The switching apparatus comprises a contact point 2, an arc quenching device associated with the contact point, and an arc blowing device for generating a magnetic blowout field. The illustration in FIG. 1 only shows the components or parts of the electrical switching apparatus essential for the present invention.

The contact point 2 consists of the contact 3 and the counter contact 4. Contact 3 and counter contact 4 can be brought into contact with each other by means of a drive (not shown) of the switching apparatus according to the invention.

The arc quenching device assigned to the contact point 2 comprises a plurality of quenching elements 5 spaced apart from one another, of which only a single quenching element is visible in FIG. 1. The quenching elements 5 are best seen in FIG. 3, which shows a longitudinal section of the switching apparatus according to the invention, and in FIG. 2, which shows a cross section of the switching apparatus according to the invention through a group of the quenching elements. As shown in FIG. 2, the quenching elements 5 each comprise a permanent magnet 6.

The arc blowing device of the electrical switching apparatus according to the invention substantially consists of the two blowing magnets 15 shown in FIG. 1 and the two pole plates 16 aligned parallel to each other, which are assigned to the two blowing magnets 15. The blowing magnets 15 are also permanent magnets. Together with the pole plates 16, they generate a homogeneous magnetic blowout field, through which a switching arc arising when the contact point 2 is opened is blown away from the contact point 2 towards the quenching elements 5. The magnetic blowout field is here supported by the permanent magnets 6 of the quenching elements 5. In any case, the permanent magnets 6 of the quenching elements 5 are polarized in such a way that the switching arc is sucked to the quenching elements 5 and is quenched by them. While the blowing magnets 15 are firmly connected to the remaining structure of the electrical switching apparatus not shown further, the pole plates 16 are part of an assembly 17, which also contains the arc quenching device of the electrical switching apparatus according to the invention. The assembly 17 can be fitted and removed in a particularly simple manner and without the use of tools. For this purpose, the pole plates 16 comprise protruding lugs 22 which can be magnetically locked with the blowing magnets 15

As shown in FIG. 3, the quenching elements 5 are arranged on a top side 19, a bottom side 20 opposite the top side, and an outer side 21 of a quenching chamber of the electrical switching apparatus. The top side 19 and the bottom side 20 are connected to each other by the outer side 21. The quenching elements 5 are arranged spaced apart from one another and distributed along a first direction. This first direction follows the connection between top side, outer side and bottom side and is illustrated in FIG. 3 by the broken line 11. As FIG. 2 shows, each of the quenching elements comprises a permanent magnet 6 and a protective sleeve 8 surrounding the permanent magnet 6. The protective sleeves 8 are preferably made of ceramic, but can also be made of another suitable, electrically insulating material. The permanent magnets 6 of the quenching elements 5 are held in different positions within the protective sleeves 8 by means of appropriate spacers 9, so that the permanent magnets 6 are offset from each other in a second direction 12, which is perpendicular to the first direction 11 and is shown in FIG. 2. The permanent magnets 6, viewed in a plane spanned by the first direction 11 and the second direction 12, are arranged according to a wave-shaped pattern. The permanent magnets 6 are each located at the zero crossing and in the positive and negative vertices of a sinusoidal wave.

The spacers 9 are part of a holder 10, which in turn is part of the assembly 17 and holds all quenching elements 5 of the arc quenching device in position. The holder 10 is of a two-part design and consists of the halves 13 and 14. A first spacer of each quenching element is respectively made integral with the first half 13 of the holder, and a second spacer of the same quenching element is made integral with the second half 14 of the holder. The associated permanent magnet of the quenching element is arranged between the two spacers. In the case of the permanent magnets 6 which are arranged in the vertices of the sine curve, one of the two spacers is omitted.

FIG. 3 shows that the quenching elements on an outer side facing away from the contact point 2 have also each assigned thereto a rib 18 extending substantially perpendicular to the first direction 11 and perpendicular to the second direction 12. The ribs 18 are similar to conventional quenching elements and form an extension of the quenching elements 5. They protrude centrally from the quenching elements 5 or from the ceramic protective sleeves 8 towards the outside. The ribs can be made of plastic or ceramic. They are preferably made in one piece with one half of the holder 10.

The function of the electrical switching apparatus according to the invention is explained in the following.

When the contact point 2 is opened, a switching arc 7 is created between contact 3 and counter contact 4. This is shown in FIG. 3. It is blown away from the contact point 2 towards the quenching elements 5 of the arc quenching device due to the magnetic blowout field generated by the blowing magnets 15 and the two pole plates 16. It is thereby elongated accordingly on the way from the contact point to the quenching elements. To illustrate this, FIG. 3 shows different positions of the switching arc with 7, 7', 7", 7'" and 7"". The closer the switching arc gets to the quenching elements, the longer it becomes. By the permanent magnets 6 of the quenching elements 5 which support the magnetic blowout field, the switching arc is finally sucked onto the quenching elements 5 and quenched by the same. The ribs 18 facing away from the contact point 2 prevent an undesired re-ignition of the switching arc outside the quenching area.

As FIG. 4 shows, due to the offset of the permanent magnets 6 in the second direction 12, the switching arc 7 experiences a wave-like distortion in addition to the elongation shown in FIG. 3, which ultimately also means an additional elongation of the switching arc and ensures reliable quenching of the switching arc. The particular advantage of this is that the electrical switching apparatus can be kept particularly compact due to the offset provided according to the invention in the second direction 12.

FIG. 5 shows a longitudinal section through a switching apparatus according to the invention according to a second embodiment. The switching apparatus according to FIG. 5 is a variation of the embodiment from FIGS. 1 to 4, so that the common features are not described repeatedly. In contrast to the first embodiment, the switching apparatus 1 according to FIG. 5 has a double break with two contact points 2. In this case, the contacts 3 are fixed contacts. The counter contacts 4 of the two contact points are arranged on a common contact bridge. The switching apparatus has a single arc-quenching device which is assigned to both contact points. In this embodiment, the arc quenching device also consists of a plurality of quenching elements, which are designed by analogy with the first embodiment. The arc quenching device is arranged opposite the contact bridge with respect to the fixed contacts 3. The two switching arcs arising when the contact points 2 are opened combine to form a single switching arc 7 which is driven between the two fixed contacts 3 into the arc quenching device. In the embodiment shown in FIG. 5, the ribs 18 are designed so that, together with the cylindrical protective sleeves 8, they each form a cut-off drop profile in cross-section.

The invention claimed is:

1. An electrical switching apparatus comprising:

at least one contact point, an arc quenching device associated with the contact point, the arc quenching device comprising a plurality of quenching elements which are arranged spaced apart from one another and distributed along a first direction, the quenching elements each comprising a permanent magnet of a plurality of permanent magnets, and an arc blowing device to generate a magnetic blowout field, by which a switching arc arising when the contact point is opened is blown away from the contact point towards the quenching elements, the magnetic blowout field being at least partially generated or supported by the permanent magnets of the quenching elements, wherein the permanent magnets of the quenching elements are offset with respect to each other in a second direction that is perpendicular to the first direction.

2. The electrical switching apparatus according to claim 1, wherein the second direction is parallel to a main direction of the magnetic blowout field.

3. The electrical switching apparatus according to claim 1, wherein the permanent magnets of the quenching elements, viewed in a plane spanned by the first direction and the second direction, are arranged according to a wave-shaped pattern.

4. The electrical switching apparatus according to claim 1, wherein the permanent magnets of the quenching elements, viewed in a plane spanned by the first direction and the second direction, are arranged according to a zigzag pattern.

5. The electrical switching apparatus according to claim 1, wherein the quenching elements each comprise a protective sleeve made of an electrically insulating material, which surrounds the respectively associated permanent magnet of the quenching element.

6. The electrical switching apparatus according to claim 1, wherein the arc blowing device comprises at least one dedicated blowing magnet that has assigned thereto two pole plates aligned parallel to each other, wherein the pole plates together with the quenching elements form an assembly which can be removed from the switching apparatus without tools and which can be magnetically locked with the blowing magnet.

7. The electrical switching apparatus according to claim 1, wherein the quenching elements have each assigned thereto a rib extending substantially perpendicular to the first direction and perpendicular to the second direction on an outer side facing away from the contact point.

8. The electrical switching apparatus according to claim 1, wherein the quenching elements are arranged on two opposite sides and on a side of a quenching chamber of the electrical switching apparatus connecting the two opposite sides.

9. An electrical switching apparatus comprising:

at least one contact point;

an arc quenching device associated with the contact point, the arc quenching device comprising a plurality of quenching elements which are arranged spaced apart from one another and distributed along a first direction, the quenching elements each comprising a permanent magnet of a plurality of permanent magnets, a protective sleeve made of an electrically insulating material, which surrounds the respectively associated permanent magnet of the quenching element, and spacers by which the permanent magnets are held in different positions within the protective sleeves, resulting in an offset existing in a second direction, perpendicular to the first direction, between the permanent magnets of the quenching elements; and an arc blowing device to generate a magnetic blowout field, by which a switching arc arising when the contact point is opened is blown away from the contact point towards the quenching elements, the magnetic blowout field being at least partially generated or supported by the permanent magnets of the quenching elements.

10. The electrical switching apparatus according to claim 9, wherein the spacers are part of a holder which holds all the quenching elements of the arc quenching device in position.

11. The electrical switching apparatus according to claim 9, wherein the second direction is parallel to a main direction of the magnetic blowout field.

12. The electrical switching apparatus according to claim 9, wherein the permanent magnets of the quenching elements, viewed in a plane spanned by the first direction and the second direction, are arranged according to a wave-shaped pattern.

13. The electrical switching apparatus according to claim 9, wherein the permanent magnets of the quenching elements, viewed in a plane spanned by the first direction and the second direction, are arranged according to a zigzag pattern.

14. The electrical switching apparatus according to claim 9, wherein the arc blowing device comprises at least one dedicated blowing magnet that has assigned thereto two pole plates aligned parallel to each other, wherein the pole plates together with the quenching elements form an assembly which can be removed from the switching apparatus without tools and which can be magnetically locked with the blowing magnet.

15. The electrical switching apparatus according to claim 9, wherein the quenching elements have each assigned thereto a rib extending substantially perpendicular to the first direction and perpendicular to the second direction on an outer side facing away from the contact point.

16. The electrical switching apparatus according to claim 9, wherein the quenching elements are arranged on two opposite sides and on a side of a quenching chamber of the electrical switching apparatus connecting the two opposite sides.

* * * * *